US008291333B2

(12) United States Patent
Horiuchi et al.

(10) Patent No.: US 8,291,333 B2
(45) Date of Patent: Oct. 16, 2012

(54) AIR CONDITIONING CONTROLLER

(75) Inventors: Kaya Horiuchi, Sakai (JP); Hisashi Sumida, Sakai (JP); Kiyoshi Shima, Sakai (JP); Yukihiro Takagaki, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 576 days.

(21) Appl. No.: 12/525,854

(22) PCT Filed: Feb. 7, 2008

(86) PCT No.: PCT/JP2008/052011

§ 371 (c)(1),
(2), (4) Date: Aug. 5, 2009

(87) PCT Pub. No.: WO2008/099746

PCT Pub. Date: Aug. 21, 2008

(65) Prior Publication Data

US 2010/0325570 A1 Dec. 23, 2010

(30) Foreign Application Priority Data

Feb. 13, 2007 (JP) ..... 2007-032730

(51) Int. Cl.
*G06F 15/00* (2006.01)
*G06F 13/00* (2006.01)

(52) U.S. Cl. ..... 715/764; 715/772

(58) Field of Classification Search ..... 715/763–765, 715/851–853, 700, 772, 767, 771, 808
See application file for complete search history.

(56) References Cited

U.S. PATENT DOCUMENTS

| | | | | |
|---|---|---|---|---|
| 2003/0019944 | A1* | 1/2003 | Nonaka et al. | 236/51 |
| 2007/0012052 | A1* | 1/2007 | Butler et al. | 62/181 |
| 2009/0271042 | A1* | 10/2009 | Voysey | 700/275 |

FOREIGN PATENT DOCUMENTS

| | | | |
|---|---|---|---|
| JP | 05-026506 | A | 2/1993 |
| JP | 06-335071 | A | 12/1994 |
| JP | 09-170802 | A | 6/1997 |
| JP | 10-281539 | A | 10/1998 |
| JP | 2002-011275 | A | 1/2002 |
| JP | 2006-071225 | A | 3/2006 |

* cited by examiner

*Primary Examiner* — Cao "Kevin" Nguyen
(74) *Attorney, Agent, or Firm* — Global IP Counselors

(57) ABSTRACT

An air conditioning controller includes a storage component, a data receiving component configured to receive set numeric data, a display component configured to display data, and a control component. The storage component has stored operation explanation data, relationship explanation data, and setting layout display data stored therein. The stored operation explanation data defines operations of functions executed in the air conditioner. The relationship explanation data defines relationships between explanations of operations of functions and values that are set. The setting display layout data includes setting display region data and explanation display region data. The control component is configured to cause the set numeric data that the data receiving component has received to be displayed in a setting display region while causing the operation explanation data and the relationship explanation data to be displayed in an explanation display region in accordance with the setting display layout data.

12 Claims, 17 Drawing Sheets

AIR CONDITIONING CONTROLLER

CROSS-REFERENCE TO RELATED APPLICATIONS

This U.S. National stage application claims priority under 35 U.S.C. §119(a) to Japanese Patent Application No. 2007-032730, filed in Japan on Feb. 13, 2007, the entire contents of which are hereby incorporated herein by reference.

TECHNICAL FIELD

The present invention relates to an air conditioning controller that operates an air conditioner.

BACKGROUND ART

Conventionally, a controller that includes a liquid crystal display component has been known as an air conditioner controller. This controller is configured such that operation buttons and the like are indicated thereon and data that have been set and inputted are displayed on the liquid crystal display component so that a user can check the display content.

Further, for example, the air conditioner controller described in Japanese Patent Publication No. 2006-71225 (see paragraph 0040 and FIG. 9) employs a configuration that indicates a specific function, then data representing the contents of that function are displayed on one screen together with numeric data that are set and inputted by the user.

SUMMARY OF THE INVENTION

Technical Problem

However, in the air conditioning controller described in patent document 1, only numeric data and data representing the content of a function are displayed together, so that when, for example, only numeric data such as "15:00" and data representing the content of a function such as "Cut Off" are displayed, the user cannot distinguish whether the air conditioner will cut off after 15 minutes or will cut off at 15:00. For this reason, the user must refer to instruction manual or the like to check for a detailed explanation of the display content.

The present invention has been made in view of the aforementioned point, and it is an object of the present invention to provide an air conditioning controller with which it is possible to understand the relationship between operations of functions and set values by just display content.

Solution to the Problem

An air conditioning controller according to a first aspect of the present invention is an air conditioning controller that operates an air conditioner, and the air conditioning controller comprises a storage component, a data receiving component and a display component. The storage component stores operation explanation data that explain operations of functions executed in the air conditioner, relationship explanation data that explain relationships between the explanations of the operations of the functions and values that are set, and setting display layout data. The setting display layout data include a setting display region that displays values that are set and an explanation display region for displaying the operation explanation data and the relationship explanation data. The data receiving component receives setting of numeric data. The display component that causes numeric data that the data receiving component has received to be displayed in the setting display region while causing the operation explanation data and the relationship explanation data to be displayed in the explanation display region in accordance with the setting display layout data.

Here, the air conditioning controller does not singly display, on the display component, numeric data whose setting has been received by the data receiving component, but rather the air conditioning controller uses each of the setting display region and the explanation display region included in the setting display layout data to cause numeric data that have been received to be displayed together with the operation explanation data and the relationship explanation data. For this reason, not only are set values simply displayed, but an explanation of the operation of a function executed in the air conditioner and the relationship between the explanation of the operation of the function and the set values are explained, so the user can easily understand what kind of operation of a function of the air conditioner that set values corresponds to.

Thus, data that the data receiving component has received are displayed in the setting display region, so it becomes possible for the user to set values while viewing the display of the display component and easily understanding what kind of operation of a function of the air conditioner that the user is setting.

An air conditioning controller according to a second aspect of the present invention is the air conditioning controller according to the first aspect of the invention, wherein the storage component further stores per-function title data in accordance with the operation explanation data. The setting display layout data further include a title display region for displaying the title data. The display component causes numeric data that the data receiving component has received to be displayed in the setting display region while respectively causing the operation explanation data and the relationship explanation data to be displayed in the explanation display region and the title data to be displayed in the title display region in accordance with the setting display layout data.

Here, title data corresponding to a function that the user is currently setting are also displayed in the title display region.

Thus, the user can easily understand, by the title also, the function that the user is currently setting, so it becomes possible to improve the user-friendliness of the air conditioning controller.

An air conditioning controller according to a third aspect of the present invention is the air conditioning controller according to the first aspect or the second aspect of the invention, wherein the setting display layout data include a plurality of the setting display regions. A plurality of the relationship explanation data are indicated in each of the plural setting display regions. The display component causes a plurality of numeric data that the data receiving component has received to be displayed in each of the corresponding setting display regions while causing the operation explanation data and the plurality of the relationship explanation data to be displayed in the explanation display region in accordance with the setting display layout data.

Here, a plurality of the setting display regions are displayed at the same time, so that when the user inputs each value to the setting display regions from the data receiving component, the user can perform setting of setting display regions to which the user has not inputted values while understanding which of the plural setting display regions the user has finished inputting values to.

Thus, it becomes possible for the user to perform set and input in the data receiving component while understanding the relationship with each set value.

An air conditioning controller according to a fourth aspect of the present invention is the air conditioning controller according to any of the first aspect to the third aspect of the invention, wherein the storage component stores function content explanation data that explain contents of the functions, function content explanation layout data for displaying the function content explanation data, and selection layout data that display function content explanation titles that are directly linked to the function content explanation layout data and setting titles that are directly linked to the setting display layout data. The data receiving component receives selection data of either the function content explanation titles or the setting titles. The display component performs display in accordance with the selection layout data, performs display in accordance with the function content explanation layout data when the function content explanation titles have been selected in the data receiving component, and performs display in accordance with the setting display layout data when the setting titles have been selected in the data receiving component.

Here, the data receiving component receives selection of a title in a state where the function content explanation titles and the setting titles are being displayed in the selection layout data. Additionally, data are directly linked to data of each of the titles, so the function content explanation data are directly displayed in the function content explanation layout data in accordance with a selection, and the operation explanation data, the relationship explanation data and the numeric data can be displayed in the setting display layout data. In this case, the air conditioning controller can return to just one higher level and transition to display of the setting display layout data after displaying the function content explanation layout data.

Thus, it becomes possible to perform each display without having to perform operation such as significantly returning to a higher level.

Advantageous Effects of the Invention

In the air conditioning controller of the first aspect of the invention, data that the data receiving component has received are displayed in the setting display region, so it becomes possible for the user to set values while viewing the display of the display component and easily understanding what kind of operation of a function of the air conditioner that the user is setting.

In the air conditioning controller of the second aspect of the invention, the user can easily understand, by a title also, the function that is being set, so it becomes possible to improve the user-friendliness of the air conditioning controller.

In the air conditioning controller of the third aspect of the invention, it becomes possible for the user to perform set and input in the data receiving component while understanding the relationship with each set value.

In the air conditioning controller of the fourth aspect of the invention, it becomes possible to perform each display without having to perform operation such as significantly returning to a higher level.

DETAILED DESCRIPTION OF THE INVENTION

Below, one embodiment of an air conditioning controller 1 that performs operation of an air conditioner 100 of the present invention will be described on the basis of the drawings.

<Overall General Configuration>

Figure 1:
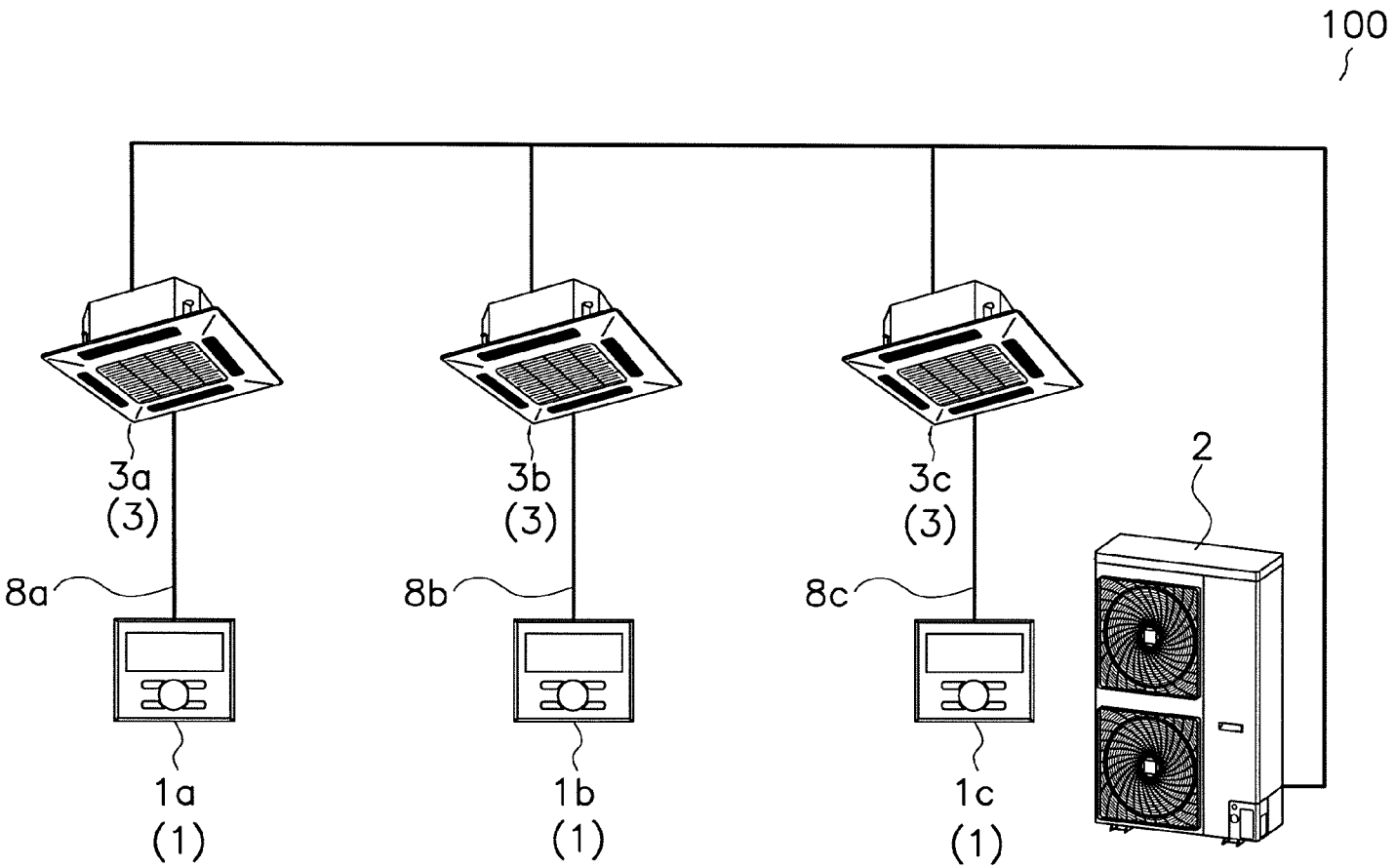
FIG. 1 is a general configuration diagram of an air conditioner in which an air conditioning controller according to one embodiment of the present invention is employed.
Figure 2:
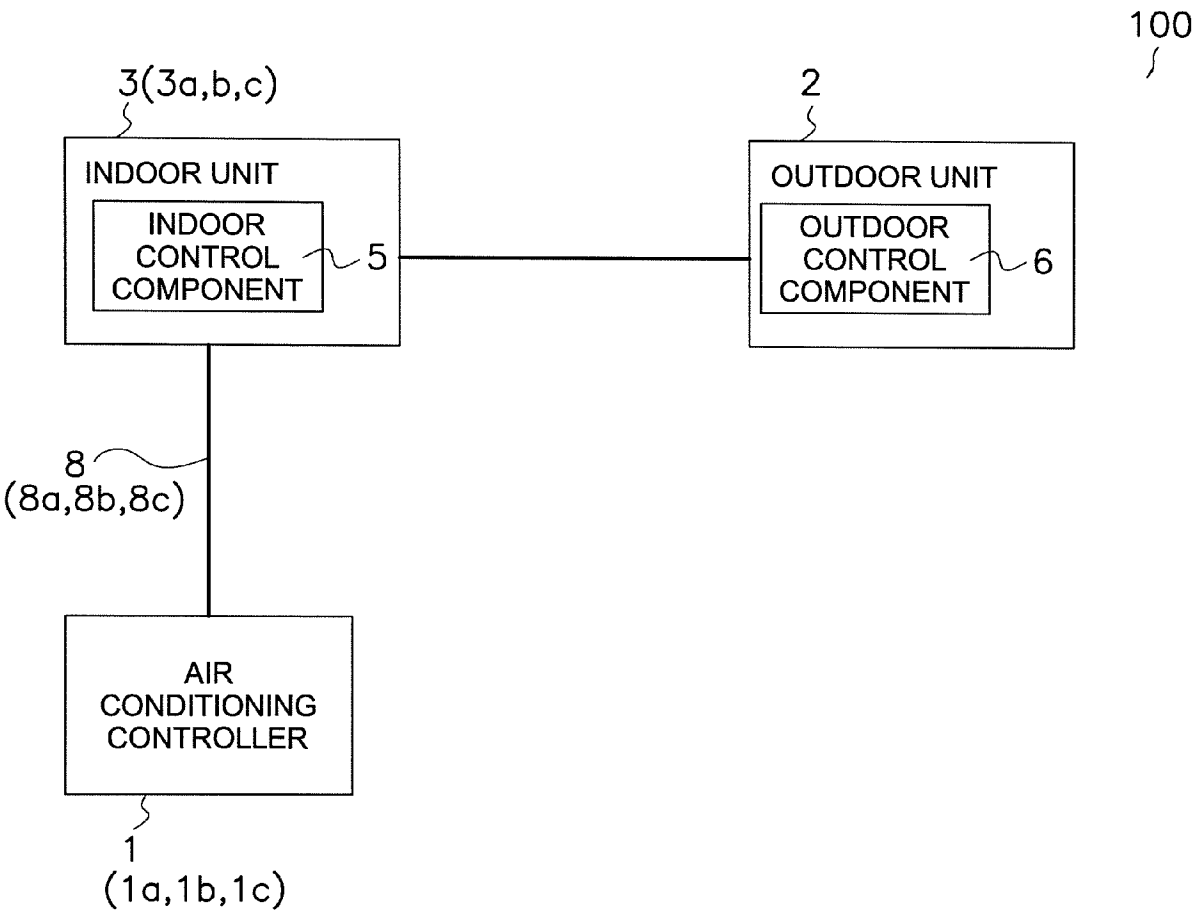
FIG. 2 is a general block configuration diagram of the air conditioner and the air conditioning controller.

FIG. 1 is a general configuration diagram of the air conditioner 100 and the air conditioning controller 1 that operates the air conditioner 100. Further, FIG. 2 is a functional block diagram showing the relationship between the air conditioner 100 and the air conditioning controller 1.

Here, the air conditioner 100 is equipped with an outdoor unit 2 and plural indoor units 3*a*, 3*b* and 3*c* that are connected via a refrigerant pipe and a communication line to the outdoor unit 2. Additionally, an air conditioning controller 1*a* that performs operation of air conditioning operation setting is connected via a communication line 8*a* to the indoor unit 3*a*. Similarly, an air conditioning controller 1*b* that performs operation of air conditioning operation setting is connected via a communication line 8*b* to the indoor unit 3*b*, and an air conditioning controller 1*c* that performs operation of air conditioning operation setting is connected via a communication line 8*c* to the indoor unit 3*c*. Further, electrical power is supplied via the communication lines 8*a* to 8*c* to the air conditioning controllers 1*a* to 1*c*, so that electrical power can always be ensured.

<Configuration of Air Conditioning Controller 1>

Figure 3:
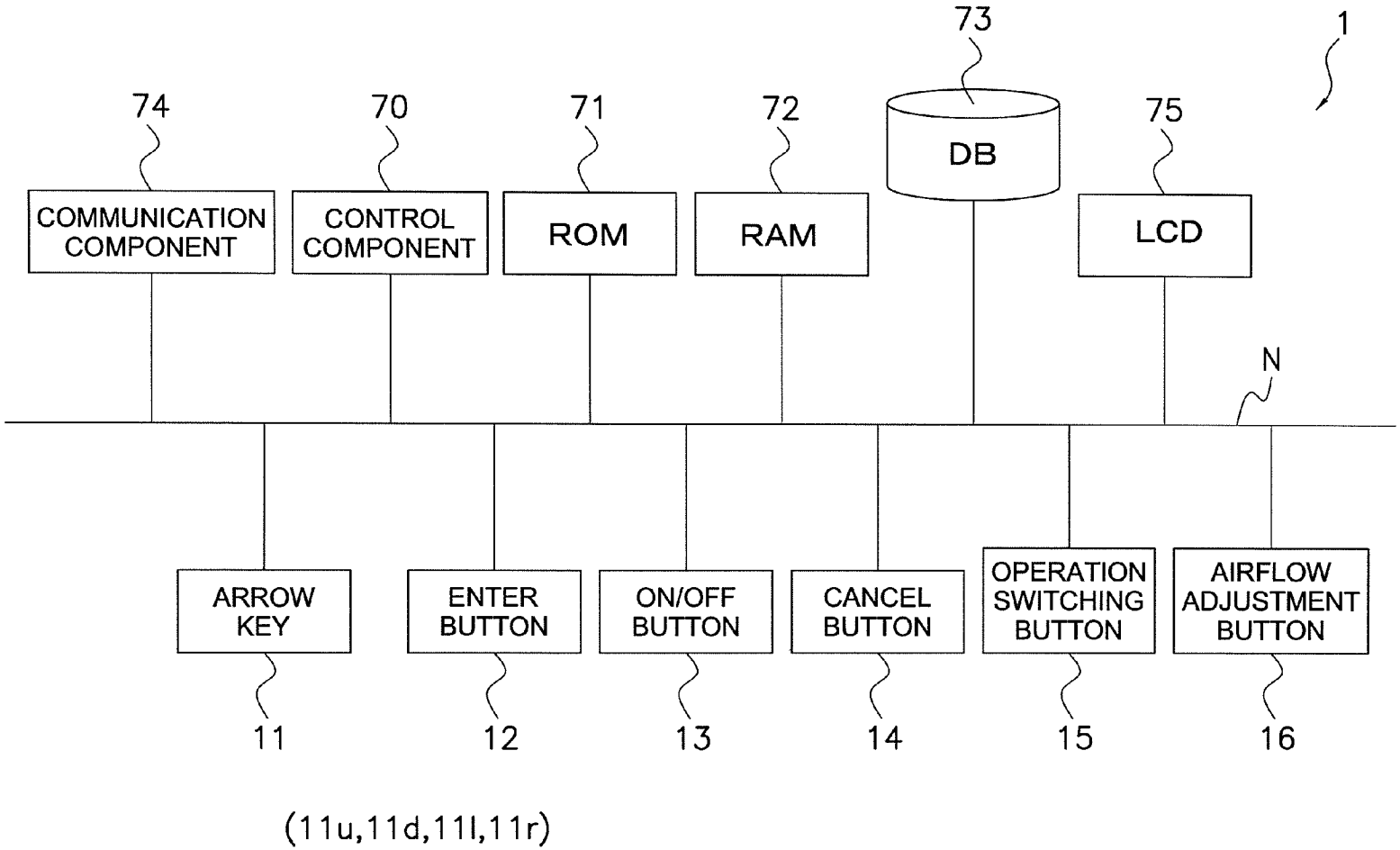
FIG. 3 is a block configuration diagram of the air conditioning controller.

FIG. 3 is a functional block diagram of the air conditioning controller 1.

The air conditioning controller 1 is equipped with a communication component 74, a control component 70, a ROM 71, a RAM 72, a database 73, an LCD 75 and various operation buttons 11 to 16 through a network N.

The communication component 74 is connected to the indoor unit 3 via the aforementioned communication line 8, transmits setting information from the air conditioning controller 1, and performs reading of data of the operating state of the air conditioner 100 and the like.

In the database 73, there are stored data that become necessary when performing setting and layout data when executing various functions that the air conditioner 100 includes.

As the layout data, the database 73 stores beforehand, in order from a higher level, basic layout data D, main menu layout data D1, detailed function selection layout data D2, function content explanation layout data D41, setting display layout data D42, and setting higher level layout data D3 that displays setting title data D3*a* of a data format that is directly linked to the setting display layout data D42 and the like.

Moreover, as mentioned later, there are also stored the setting title data D3*a* that are directly linked to the setting display layout data D42, function content explanation data D42*d* whose content is displayed when the function content explanation layout data D41 is displayed, function content explanation title data D3*b* that are directly linked to the function content explanation layout data D41, operation explanation data D42*a* that are shown when displayed by the function content explanation layout data D41, relationship explanation data D42*b*, per-function title data D42*c*, one or plural setting display region data D422, explanation display region data D421 for displaying the operation explanation data D42*a* and the relationship explanation data D42*b*, and title display region data D423 and the like.

Figure 4:
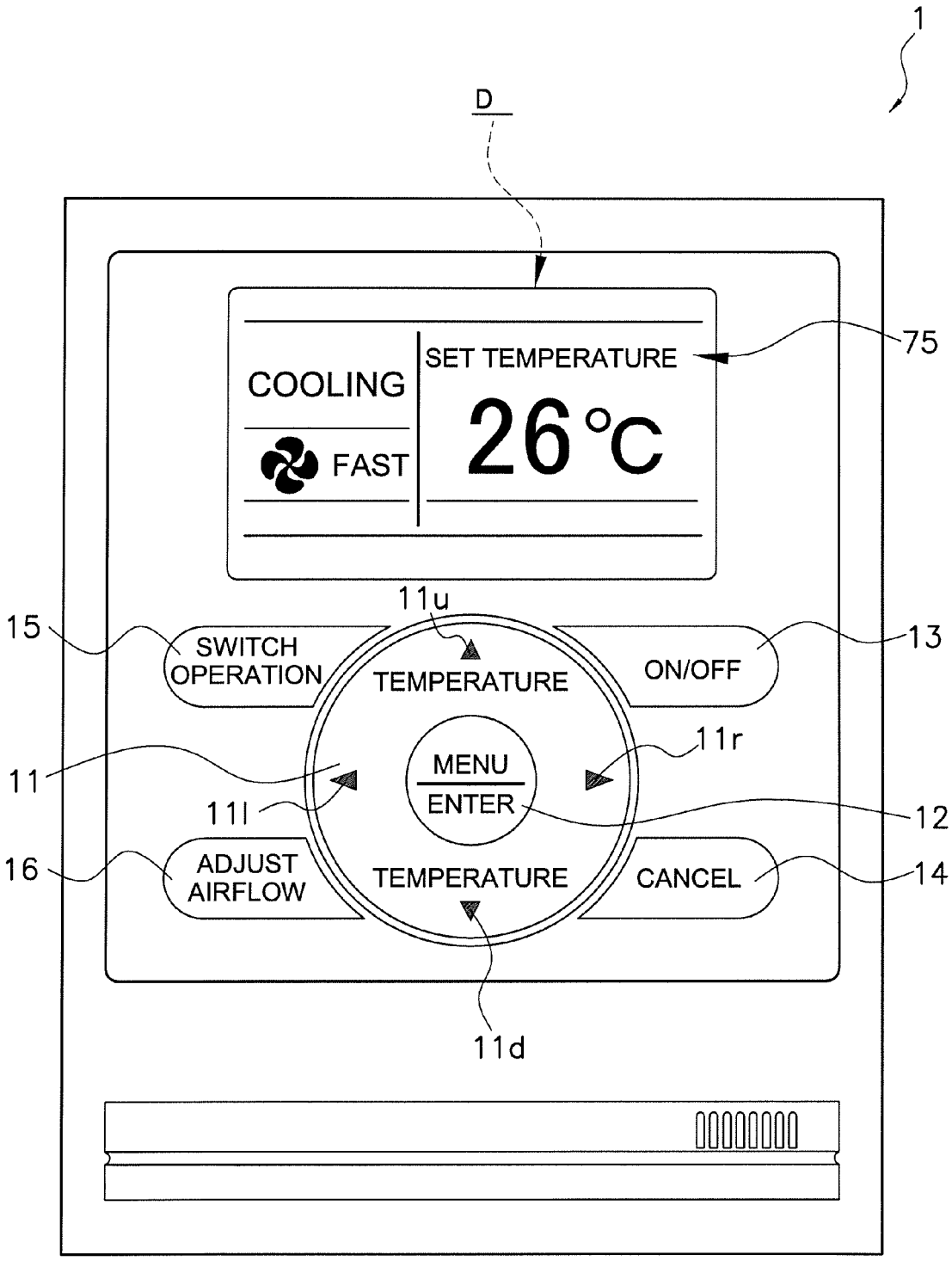
FIG. 4 is a diagram showing a display state of a basic screen of the air conditioning controller.

The LCD 75 is, as shown in FIG. 4, a liquid crystal display component on which are displayed data of FIG. 4 to FIG. 16 as a result of the control component 70 performing data processing on the basis of data that have been inputted via the various operation buttons 11 to 16 or on the basis of data that the communication component 74 receives from the air conditioner 100 by communication.

The various operation buttons 11 to 16 specifically include, as shown in FIG. 4, an arrow key 11 (11*u*, 11*d*, 11*l*, 11*r*), an enter button 12, an ON/OFF button 13, a cancel button 14, an operation switching button 15 and an airflow adjustment button 16, and information that has been inputted from each of the keys is processed by the control component 70.

Of these, the arrow key 11 is a key with which cursor input is possible, and the arrow key 11 is equipped with an up key 11*u* that includes the function of moving the cursor up to raise set values, a down key 11*d* that includes the function of moving the cursor down to lower set values, a left key 11*l* that includes the function of moving the cursor left to move to a setting screen in regard to an item that has been selected and the like, and a right key 11*r* that includes the function of moving the cursor right to return to a level where is just one level higher from the screen display that has been selected.

The enter button 12 includes the function of causing the control component 70 and the LCD 75 to display a menu selection screen and, during setting or the like, go down to a lower level.

The ON/OFF button 13 includes the function of causing the control component 70 to switch the air conditioner 100 ON and OFF.

The cancel button 14 includes the function of causing the control component 70 and the LCD 75 to perform processing to cancel various setting modes and move to a basic screen display and causing the control component 70 and the LCD 75 to return to a level one higher.

The operation switching button 15 includes the function of causing the control component 70 to switch operation, such as cooling operation, heating operation and the like, relating to operations executed in the air conditioner 100.

The airflow adjustment button 16 includes the function of causing the control component 70 to adjust the airflow of the air conditioner 100.

(Basic Display Screen)

FIG. 4 shows the air conditioning controller 1 in a state where it is performing basic screen display.

Here, information of the operating mode (cooling), the set temperature (26° C.) and the operating speed (fast) is displayed by data processing by display output to the LCD 75 resulting from the control component 70 based on the basic layout data D that are stored in the database 73. In this state, when the user presses the up key 11*u* of the arrow key 11, the set temperature rises 1° C. at a time and is set. When the user presses the down key 11*d*, the set temperature falls 1° C. at a time and is set. Thus, the up key 11*u* and the down key 11*d* of the arrow key 11 function as direct keys for inputting the set temperature. Further, in this state, when the user presses the enter button 12, the air conditioning controller 1 transitions to a menu selection screen.

(Menu Selection Display Screen)

Figure 5:
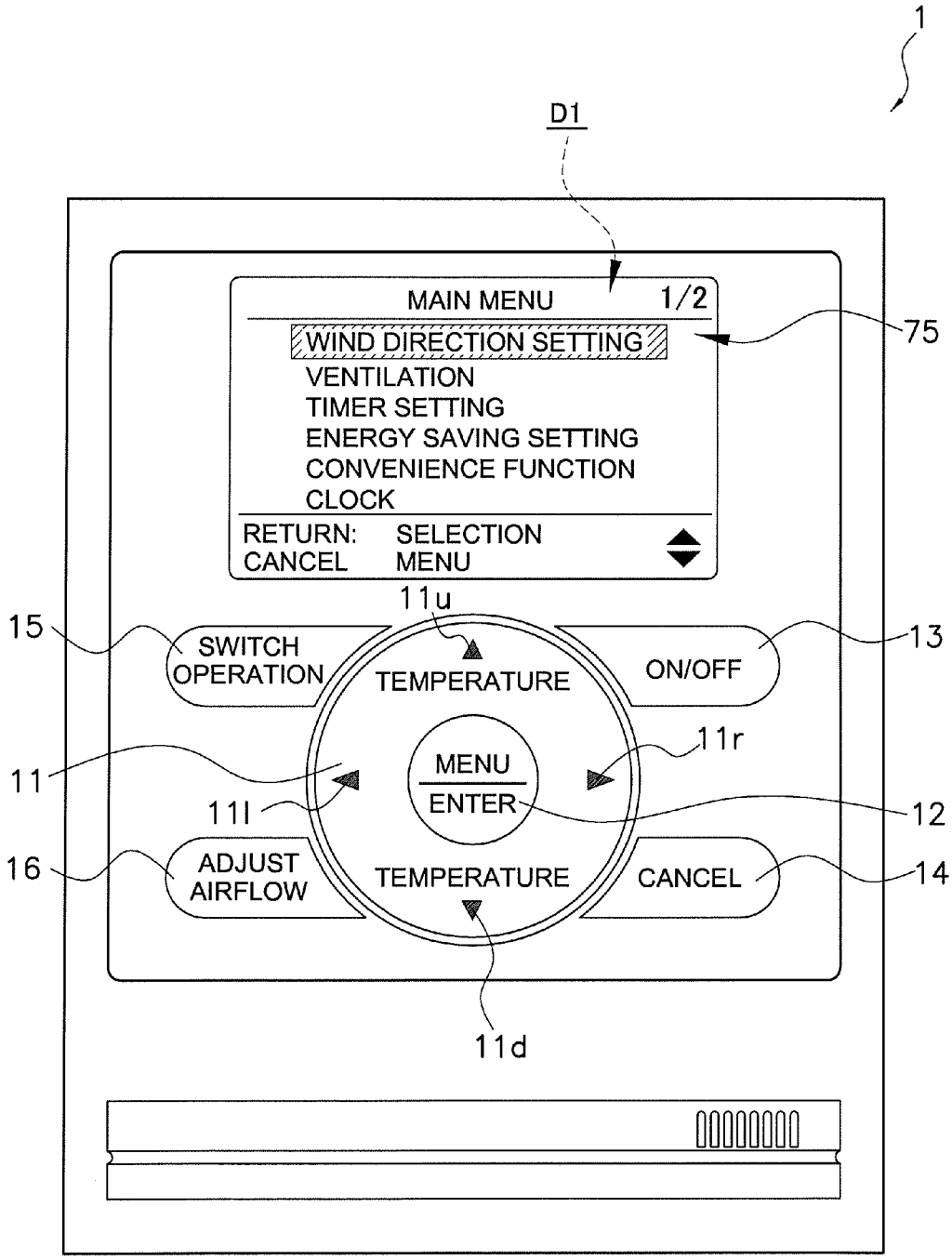
FIG. 5 is a diagram showing a display state of a menu selection display screen of the air conditioning controller.

FIG. 5 shows the air conditioning controller 1 in a state where it is performing menu selection screen display.

Here, a menu selection screen is displayed by display output to the LCD 75 resulting from the control component 70 based on the main menu layout data D1 that are stored in the database 73. Here, various menu titles such as "wind direction setting", "ventilation", "timer setting", "energy saving setting", "convenience setting", "clock" and the like are displayed in a list.

Figure 6:
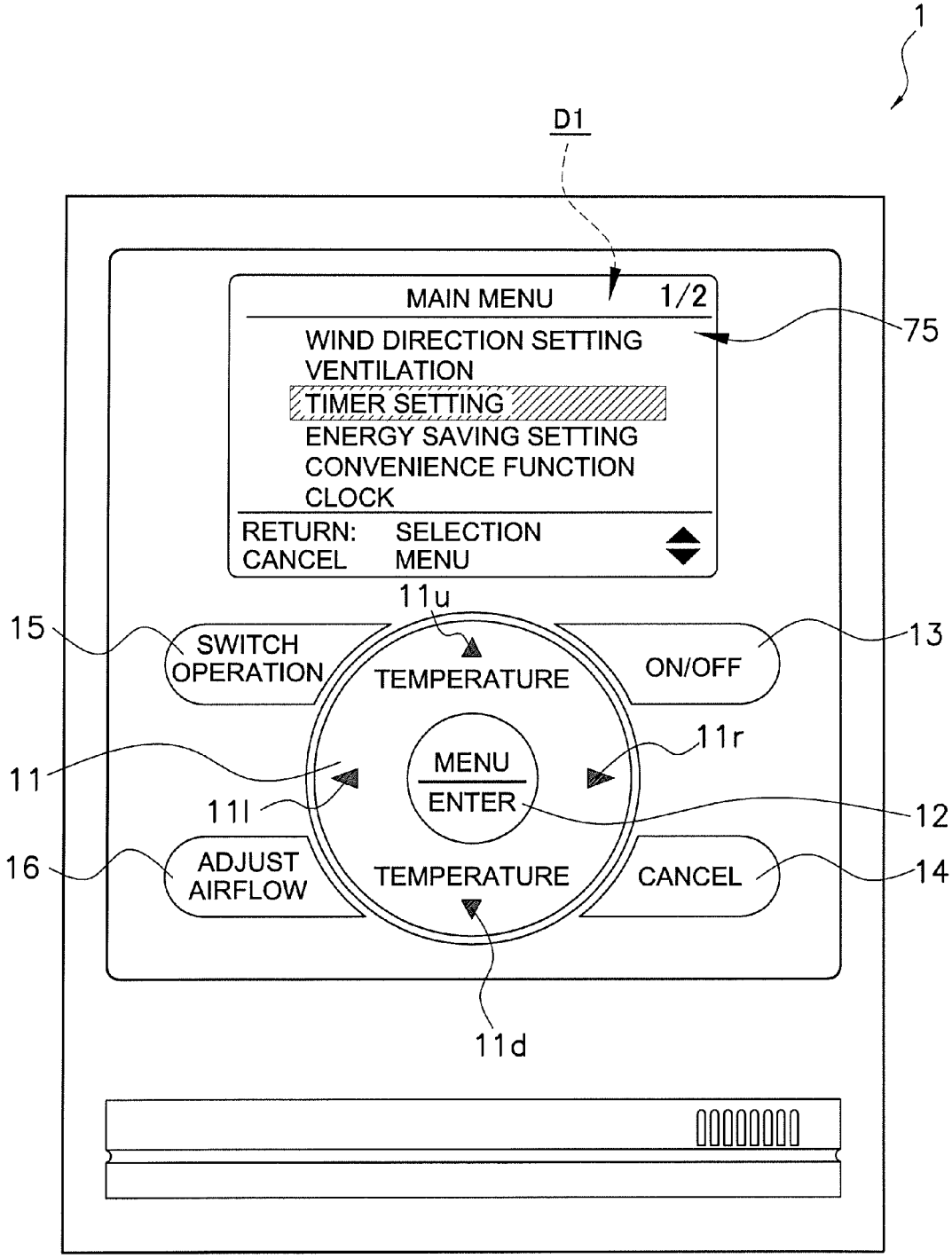
FIG. 6 is a diagram showing a display state of the menu selection display screen of the air conditioning controller where a timer setting has been selected.
Figure 7:
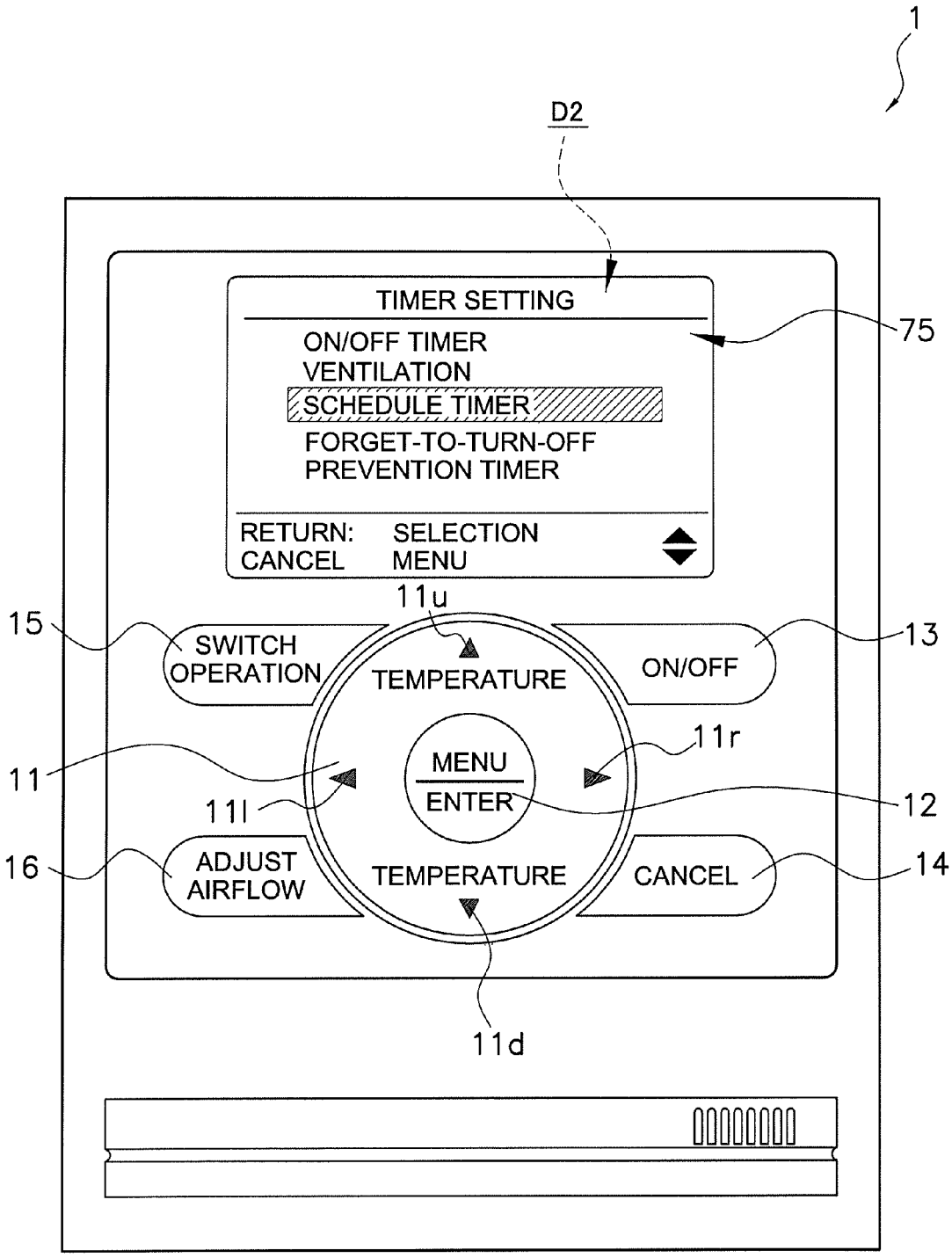
FIG. 7 is a diagram showing a display state of a detailed function selection screen of the air conditioning controller.

In a state where this display is being performed, the user can use the up key 11*u* and the down key 11*d* of the arrow key 11 to move the cursor up and down as shown in FIG. 6 to select any of the menus from among the various menu titles. Then, when the user presses the enter button in a state where the cursor is over the menu that the user wishes to select (here, for example, "timer setting"), as shown in FIG. 7, detailed function selection screen display (display of a function relating to "timer setting") on the LCD 75 based on the detailed function selection layout data D2 is performed by the control component 70. Here, the "timer setting" function is a function that sets, in advance, the air conditioner 100 to run automatically during a predetermined time.

(Detailed Function Selection Screen)

As shown in FIG. 7, on the detailed function selection screen, display of functions relating to "timer setting" is performed. Here, when the user again uses the up key 11*u* and down key 11*d* to move the cursor, selects "schedule timer", for example, and presses the enter button 12, as shown in FIG. 8, setting higher level screen display (display relating to "schedule timer") on the LCD 75 based on the setting higher level layout data D3 is performed by the control component 70.

(Setting Higher Level Screen)

Figure 8:
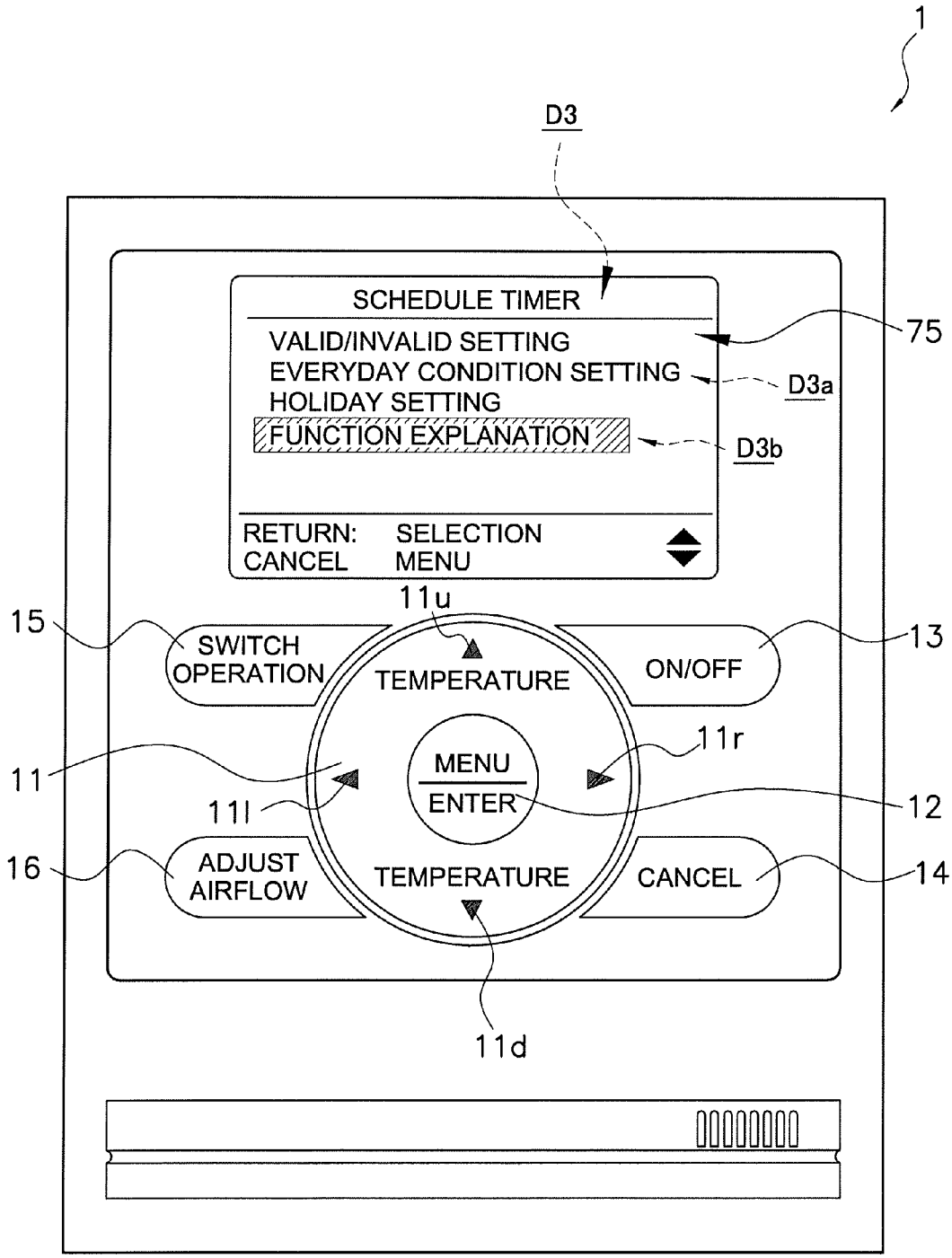
FIG. 8 is a diagram showing a display state of a setting higher level screen of the air conditioning controller.

As shown in FIG. 8, on the setting higher level screen, the control component 70 performs, with respect to the LCD 75 on the basis of the setting title data D3*a* of the database 73 (data that are directly linked to the setting display layout data D42 and stored in the database 73), display for transitioning to various settings relating to schedule timer and performs, with respect to the LCD 75 on the basis of the function content explanation title data D3*b* of the database 73 (data that are directly linked to the function content explanation layout data D41 and stored in the database 73), display for transitioning to a screen that explains the function content of schedule timer.

Moreover, the control component 70 ensures, as part of the display region resulting from the setting display layout data D42, a place to perform title display on the basis of the title display region data D423 that are stored in the database 73 and causes the title of the function that has been selected (here, "schedule timer") to be displayed on the basis of the per-function title data D42*c*.

Here also, the user uses the up key 11*u* and the down key 11*d* of the arrow key 11 to move the position of the cursor to select "function explanation", "everyday condition setting", "valid/invalid setting", etc. Here, when the enter button 12 is pressed in a state where "function explanation" has been selected, as shown in FIG. 9, the air conditioning controller 1 transitions to a function content explanation screen because the function content explanation title data D3*b* are directly linked to the function content explanation layout data D41, and when the enter button 12 is pressed in a state where "everyday condition setting" has been selected, as shown in FIG. 10, the air conditioning controller 1 transitions to a setting display screen because the setting title data D3*a* are directly linked to the setting display layout data D42.

(Function Content Explanation Screen)

Figure 9:
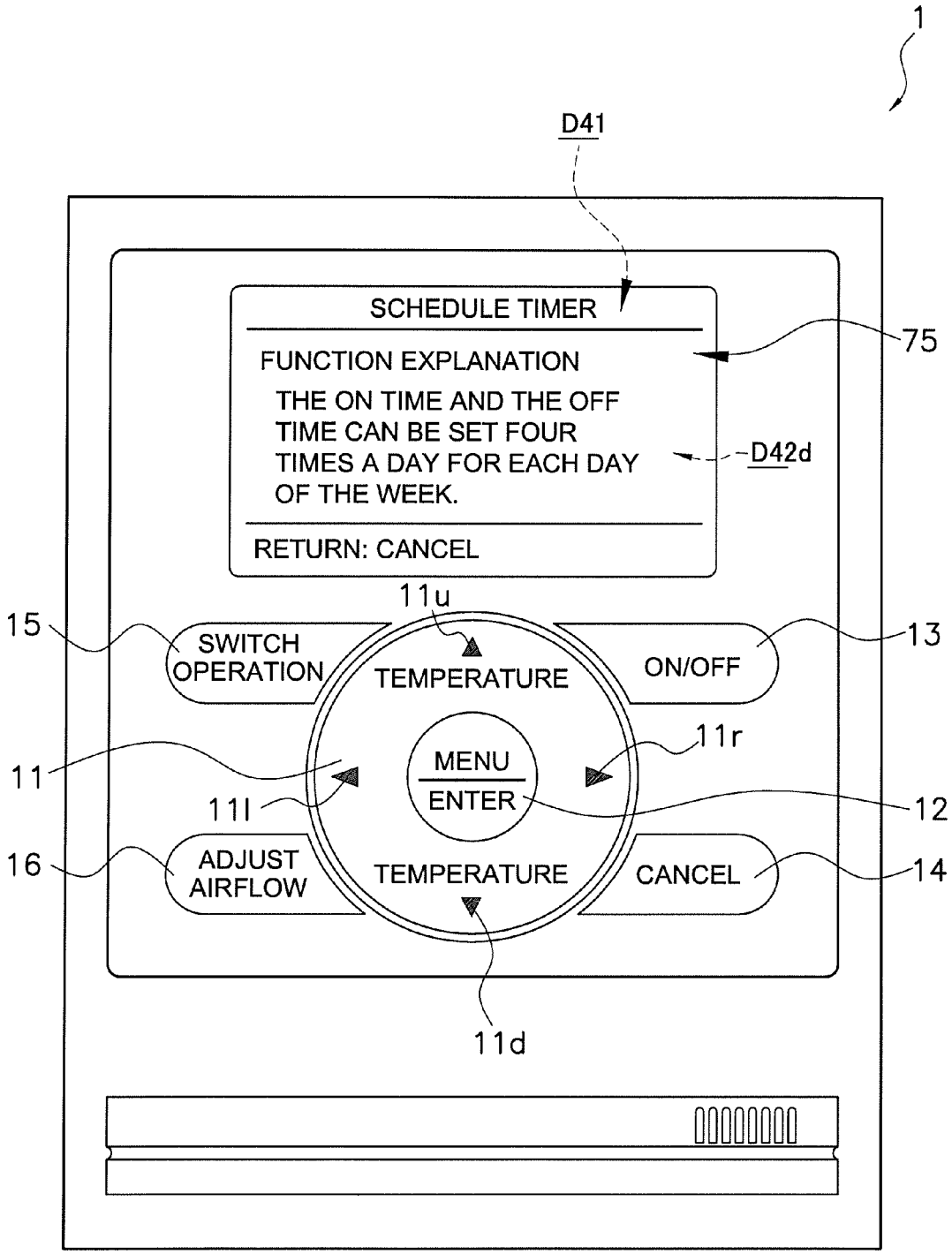
FIG. 9 is a diagram showing a display state of a function content explanation screen of the air conditioning controller.
Figure 10:
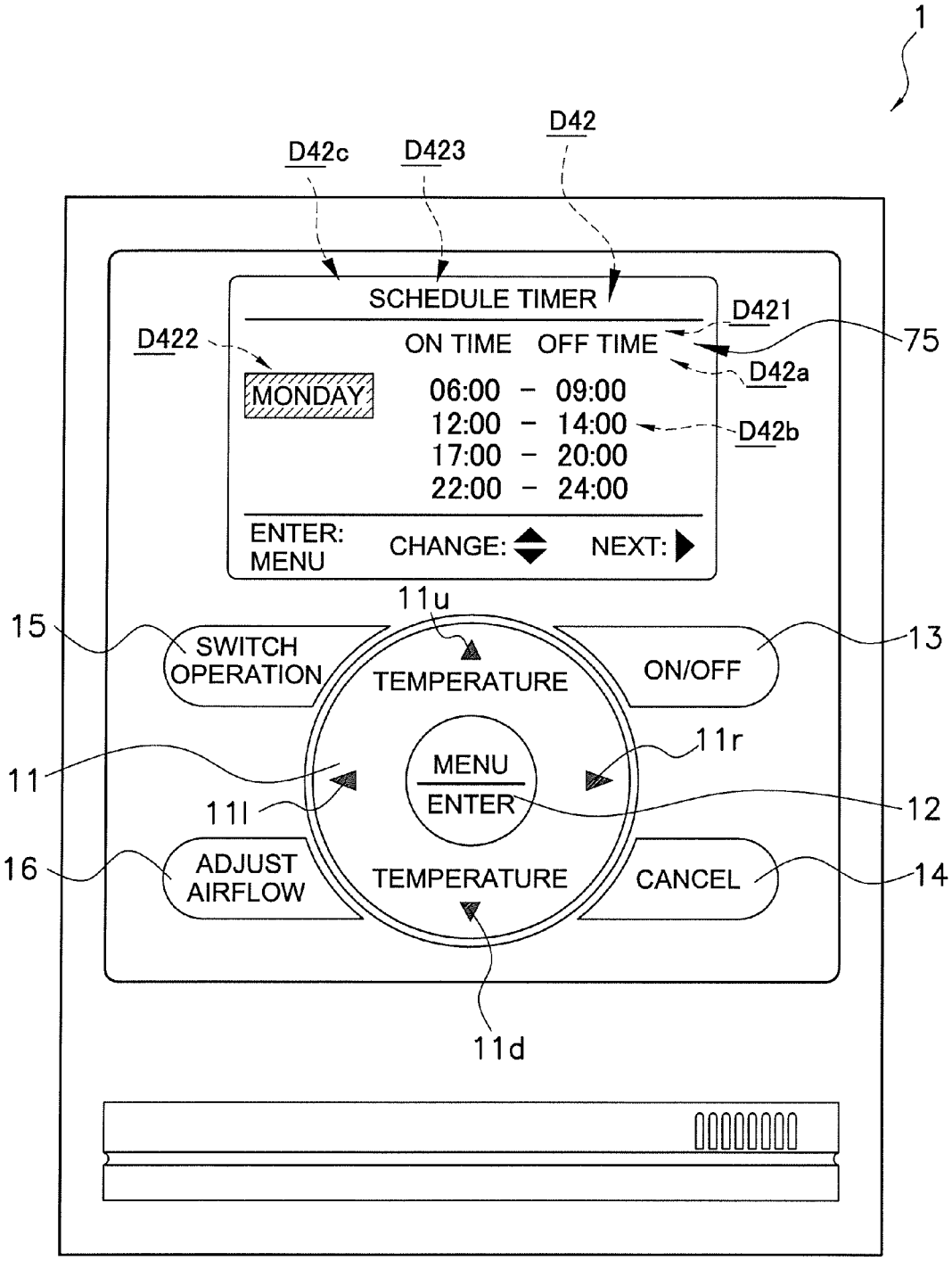
FIG. 10 is a diagram showing a display state of a setting display screen of the air conditioning controller.

FIG. 9 shows the air conditioning controller 1 in a state where it is performing setting content explanation screen display.

Here, the control component 70 performs display output resulting from a screen layout based on the function content explanation layout data D41 that are stored in the database 73 and, as for the specific explanation content, performs display on the basis of the corresponding function content explanation data D42*d*. Here, specifically, display resulting from the function content explanation layout data D41 corresponds to the display of each frame and the like in the display of the LCD 75 of FIG. 9, and display resulting from the function content explanation data D42*d* corresponds to the display of "The ON time and the OFF time can be set four times a day for each day of the week."

Here, when the user presses the cancel button 14 or the left key 11*l* of the arrow key 11, the air conditioning controller 1 can transition to the setting higher level screen, so that by selecting "everyday condition setting", the user can understand the explanation of the function and soon arrive at a setting screen by a simple operation.

It will be noted that the point that the control component 70 causes the title of the function that has been selected (here, "schedule timer") to be displayed as part of the display region resulting from the setting display layout data D42 on the basis of the title display region data D423 and the per-function title data D42*c* is the same.

(Setting Display Screen)

FIG. 10 shows the air conditioning controller 1 in a state where it is performing setting display screen display.

Here, the control component 70 performs display output resulting from a screen layout based on the setting display layout data D42 that are stored in the database 73 and, as for the specific explanation content, performs display on the basis of the corresponding operation explanation data D42*a*, the relationship explanation data D42*b* and the per-function title data D42*c*. Here, specifically, display resulting from the setting display layout data D42 corresponds to the display of each frame and the like in the display of the LCD 75 of FIG. 10, and display resulting from the operation explanation data D42*a* and the relationship explanation data D42*b* corresponds to the display of "ON time" and "OFF time" in the display of the LCD 75 of FIG. 10.

Further, as shown in FIG. 10, the control component 70 performs display output resulting from a screen layout based on the setting display layout data D42 and performs display based on the operation explanation data D42*a*, the relationship explanation data D42*b* and the per-function title data D42*c*, and operation functions are allocated on the same display screen. As for a function of the allocation of operation functions here, it is a function when each of the direction keys 11*u*, 11*d*, 11*l* and 11*r* of the arrow key 11 and the enter button 12 are operated while the LCD 75 is performing display based on the setting display layout data D42, the operation explanation data D42*a*, the relationship explanation data D42*b* and the per-function title data D42*c*. Specifically, the function of changing the content of the cursor position is allocated to the up key 11*u* and the down key 11*d* of the arrow key 11. Further, the function of causing the display screen to transition to a lower lever is allocated to the right key 11*r* of the arrow key 11. Moreover, the function of causing the display screen to transition to a setting higher level screen is allocated to the enter button 12.

Here, display output based on the operation explanation data D42*a* and the relationship explanation data D42*b* that are stored beforehand in the database 73 is done in a display region based on the explanation display region data D421 that are indicated in the setting display layout data D42 that are stored beforehand in the database 73. Further, display based on data that have been inputted by the up key 11*u* and the down key 11*d* of the arrow key 11 is done in a display region based on the setting display region data D422. A value that is displayed changes each time the user operates the arrow key 11. That is, here, the user can perform set and input with the arrow key 11 while looking at the setting display screen and understanding the entire configuration of the timer setting schedule.

It will be noted that the point that the control component 70 causes the title of the function that has been selected (here, "schedule timer") to be displayed as part of the display region resulting from the setting display layout data D42 on the basis of the title display region data D423 and the per-function title data D42*c* is the same.

(Other Display Examples)

——Regarding Automatic-Resetting-of-Set-Temperature Function——

Here, display of an "automatic resetting of set temperature" function will be described as another example with respect to display of the "schedule timer". The "automatic resetting of set temperature" function is a function where, during a predetermined amount of time, the air conditioner performs operation in a mode of a temporary set temperature that the user has inputted and then, after the predetermined amount of time, the set temperature automatically returns to a predetermined temperature.

Figure 11:
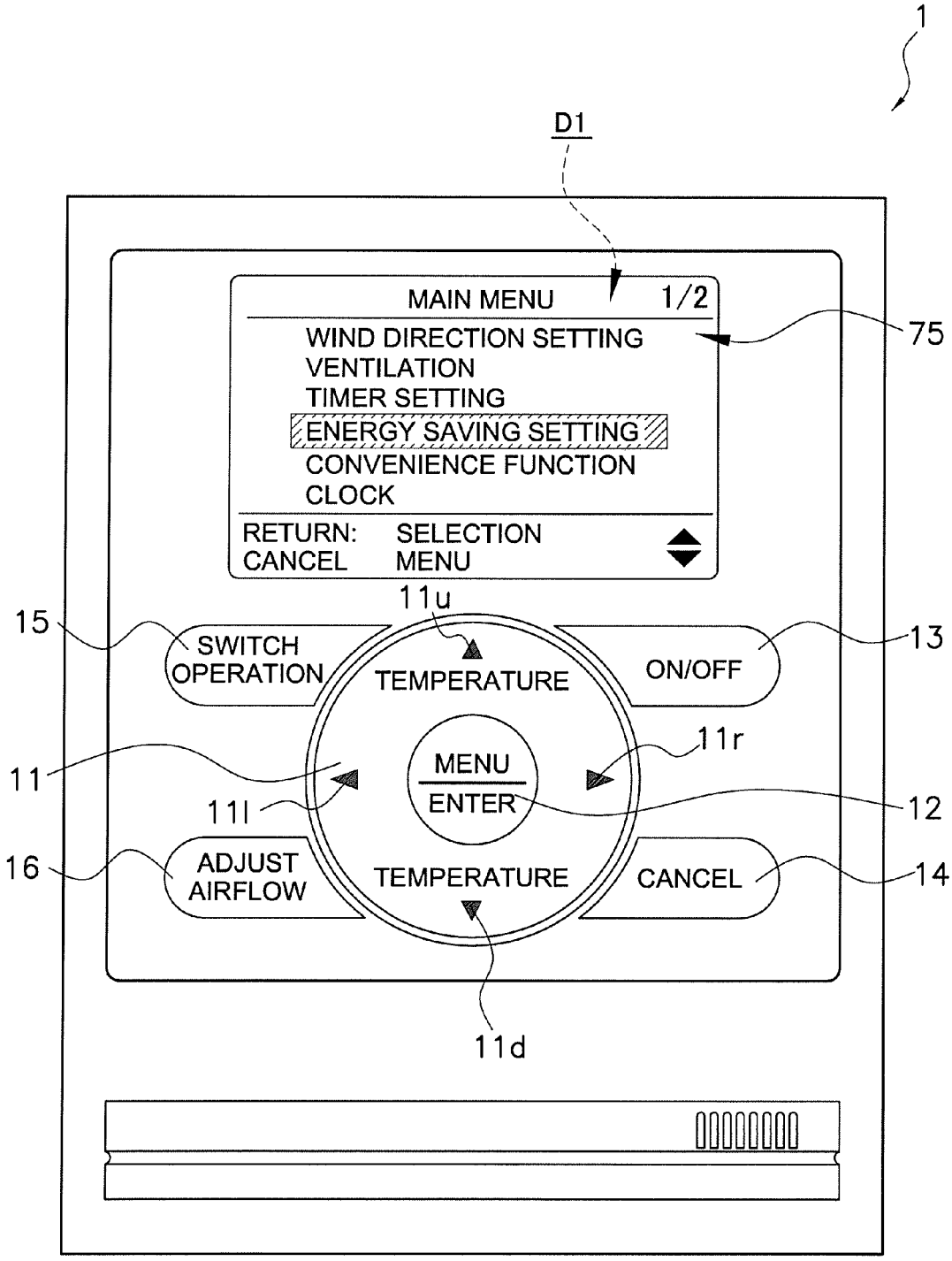
FIG. 11 is a diagram showing a display state of the menu selection display screen of the air conditioning controller where an energy saving setting has been selected.

FIG. 11 shows the air conditioning controller 1 in a state where the menu selection screen is displayed.

Here, the air conditioning controller 1 transitions to a detailed function selection screen of "energy saving setting" as a result of the cursor being moved over "energy saving setting" and "energy saving setting" being selected.

Figure 12:
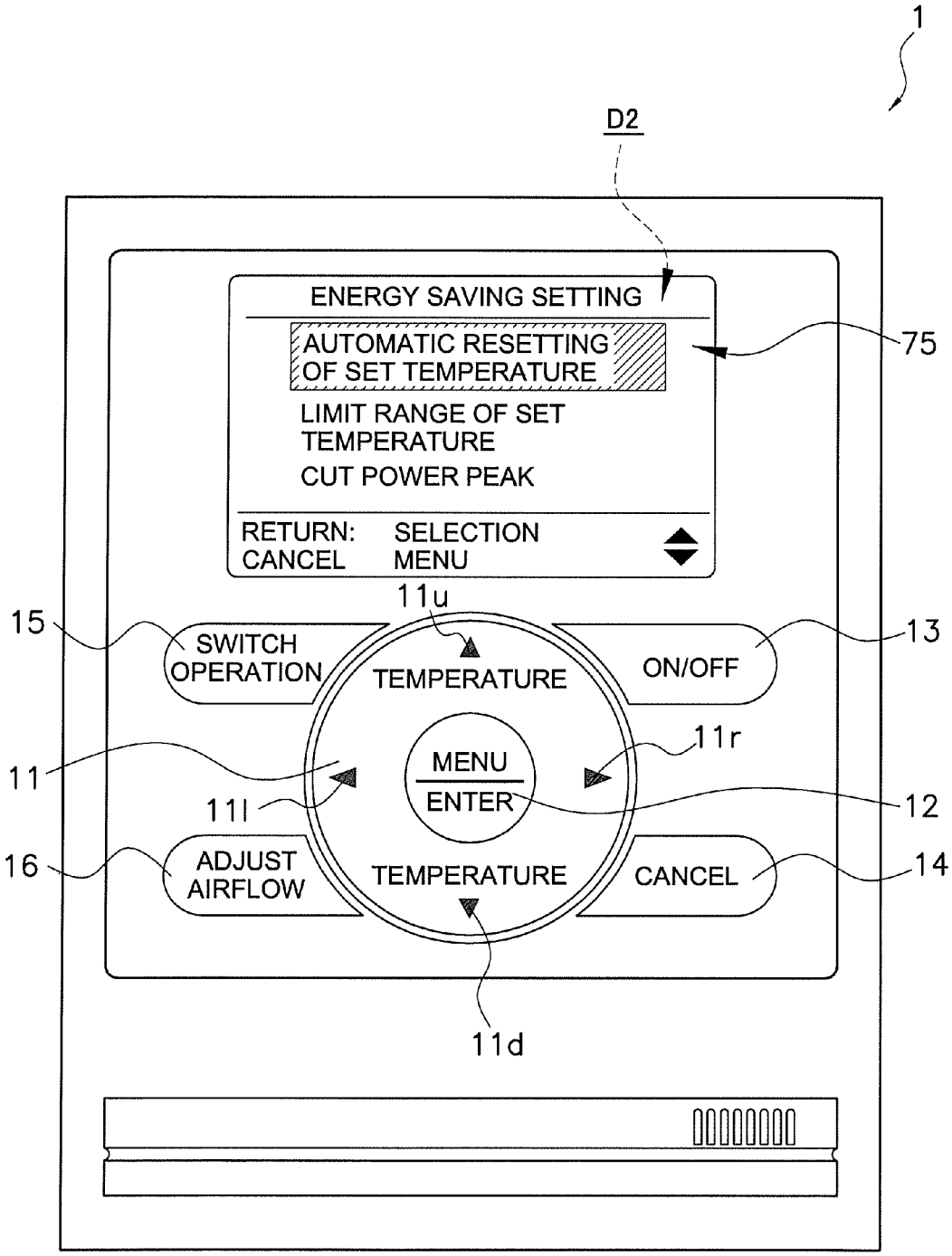
FIG. 12 is a diagram showing a display state of a detailed function selection screen of the air conditioning controller.

FIG. 12 shows the air conditioning controller 1 in a state where a detailed function selection screen is displayed.

Here, the air conditioning controller 1 transitions to a setting higher level screen of "automatic resetting of set temperature" as a result of the cursor being moved over "automatic resetting of set temperature" and "automatic resetting of set temperature" being selected.

Figure 13:
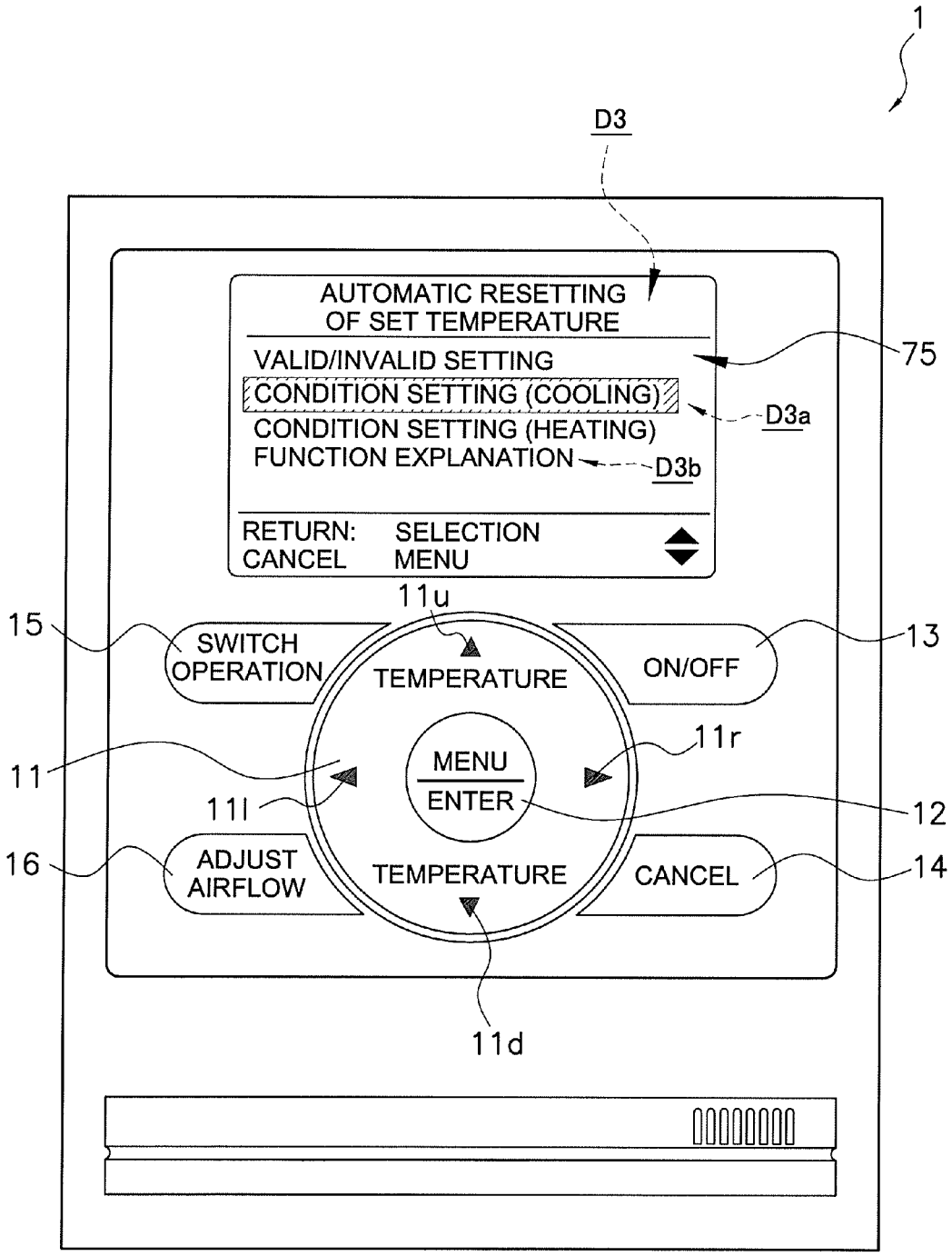
FIG. 13 is a diagram showing a display state of a setting higher level screen of the air conditioning controller.

FIG. 13 shows the air conditioning controller 1 in a state where a setting higher level screen is displayed.

Here, when "function explanation" is selected, the content of the specific function of "automatic resetting of set temperature" is displayed (see FIG. 15) as mentioned above in the description of "schedule timer". On the other hand, here, the air conditioning controller 1 transitions to a setting display screen on the basis of the setting display layout data D42 to which the setting title data D3*a* are directly linked as a result of the cursor being moved over "condition setting (cooling)" displayed by the setting title data D3*a* and "condition setting (cooling)" being selected.

Figure 14:
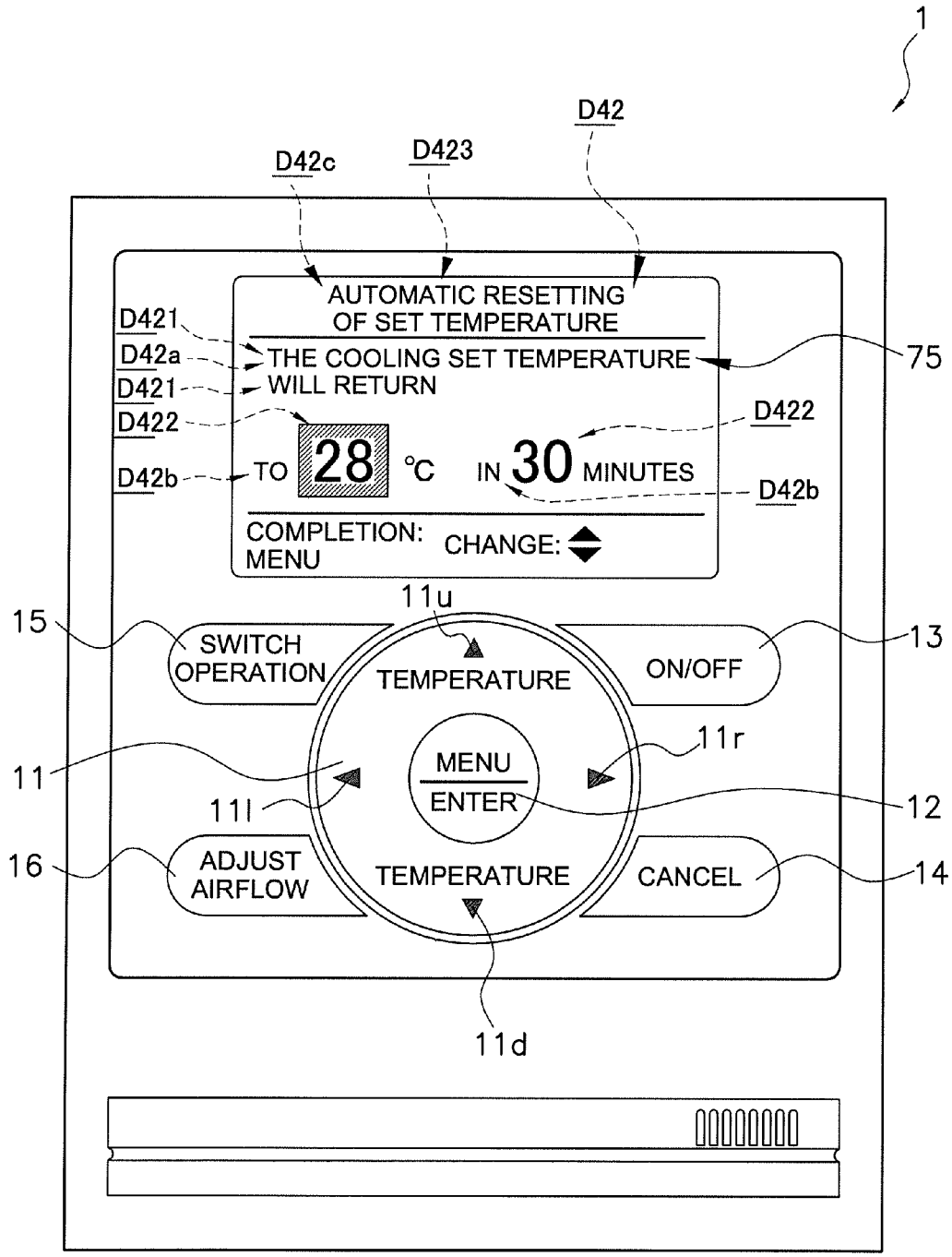
FIG. 14 is a diagram showing a display state of a setting display screen of the air conditioning controller.
Figure 15:
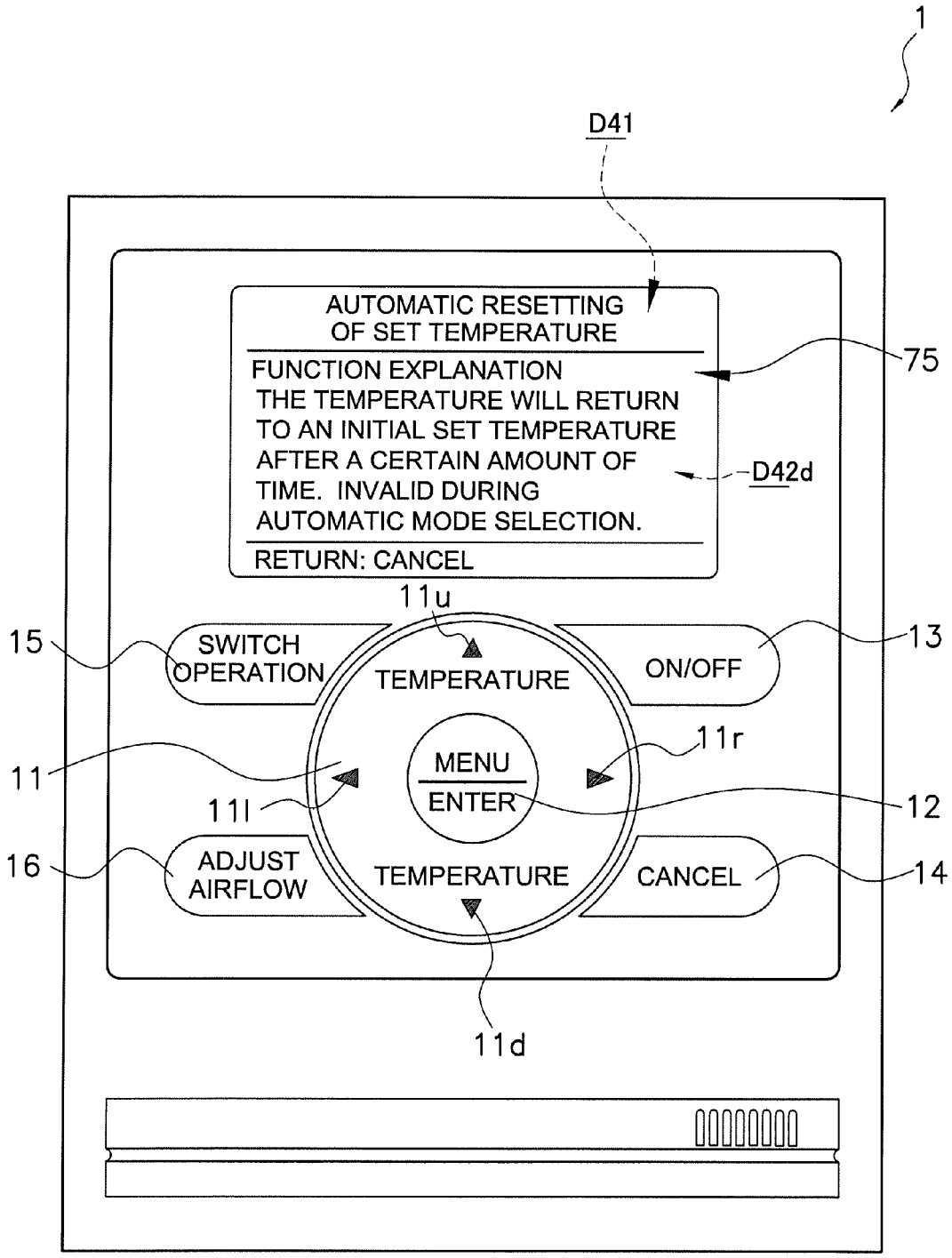
FIG. 15 is a diagram showing a display state of a function content explanation screen of the air conditioning controller.

FIG. 14 shows the air conditioning controller 1 in a state where a setting display screen is displayed.

Here, on the basis of the setting display layout data D42, the control component 70 performs display output based on the operation explanation data D42*a* and the relationship explanation data D42*b* in the explanation display region data D421 and performs display output based on data that have been inputted by the up key 11*u* and the down key 11*d* of the arrow key 11 in the setting display region data D422. Specifically, the displays of "The cooling set temperature" and "will return" shown in FIG. 14 correspond to display output resulting from the operation explanation data D42*a*, the displays of "in _ minutes" and "to _ ° C." correspond to display resulting from the relationship explanation data D42*b*, and the displays of "30" and "28" correspond to set numeric data that have been inputted by the arrow key 11. Here, the operation explanation data D42*a* display a general explanation of the function of "automatic resetting of set temperature" that has been selected, and data that have been inputted by the arrow key 11 correspond to set numeric data. Additionally, the relationship explanation data D42*b* fulfill the role of corresponding the relationship between the general explanation of the function of "automatic resetting of set temperature" and set numeric data. Thus, when "30" and "28" are simply displayed as numeric data, it is unclear to the user whether these are a unit or a time or an amount of time, but because there is display resulting from the relationship explanation data of "in _ minutes" and to "to _ ° C.", the user can clearly understand the setting content. Further, all of the information of the general explanation of the function of "automatic resetting of set temperature" resulting from the operation explanation data D42*a*, the relationship resulting from the relationship explanation data D42*b* and the input numeric data resulting from the arrow key 11 are displayed at one time on one screen of the LCD 75 by the control component 70, so the user can easily understand at one time the setting content.

Further, here, two sets of data that are the setting display region data D422 in front of "in _ minutes" and the setting display region data in front of "to _ ° C.", that is, a plurality of the setting display regions, are shown on one screen. Additionally, as for input with respect to each of these setting display regions, by pressing the left key 11*l* and the right key 11*r* of the arrow key 11 and moving the cursor over any of the setting display regions, the user can understand which setting the user is performing. Moreover, when one input ends and the user does another input, data that have been inputted before remain displayed on the same screen, so the user can input other values while checking the values that the user inputted before. Here, there are shown the examples of "in 30 minutes" and "to 28° C.", but even when the user inputs "in 15 minutes" and thereafter wishes to set the temperature as "to 24° C.", which is a somewhat low temperature, the user can easily set the temperature while viewing that it is a setting in 15 minutes.

It will be noted that the point that the control component 70 causes the title of the function that has been selected (here, "automatic resetting of set temperature") to be displayed as part of the display region resulting from the setting display layout data D42 on the basis of the title display region data D423 and the per-function title data D42*c* is the same.

——Regarding Peak Cut——

Figure 16:
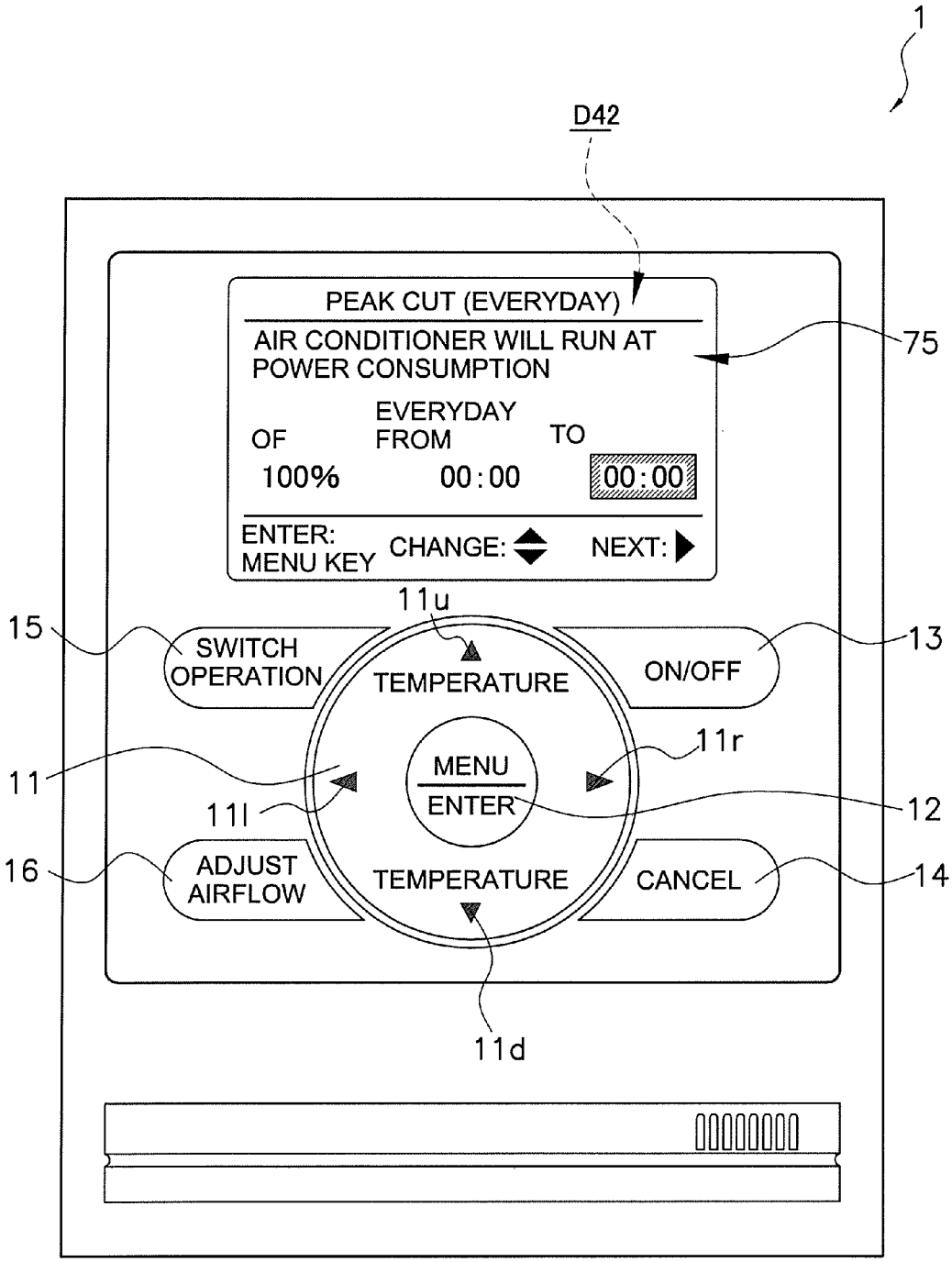
FIG. 16 is a diagram showing a display state of a setting display screen of a peak cut function of the air conditioning controller.

FIG. 16 shows the air conditioning controller 1 in a state where it is performing "peak cut" setting display screen display. Here, "peak cut" is part of the function of the energy saving setting and is a function that can control power consumption during a time span when power consumption becomes the highest.

Here, as shown in FIG. 16, the time designation and the percentage of the operational output of the air conditioner 100 can be set in the setting display screen.

——Regarding Quiet Mode——

Figure 17:
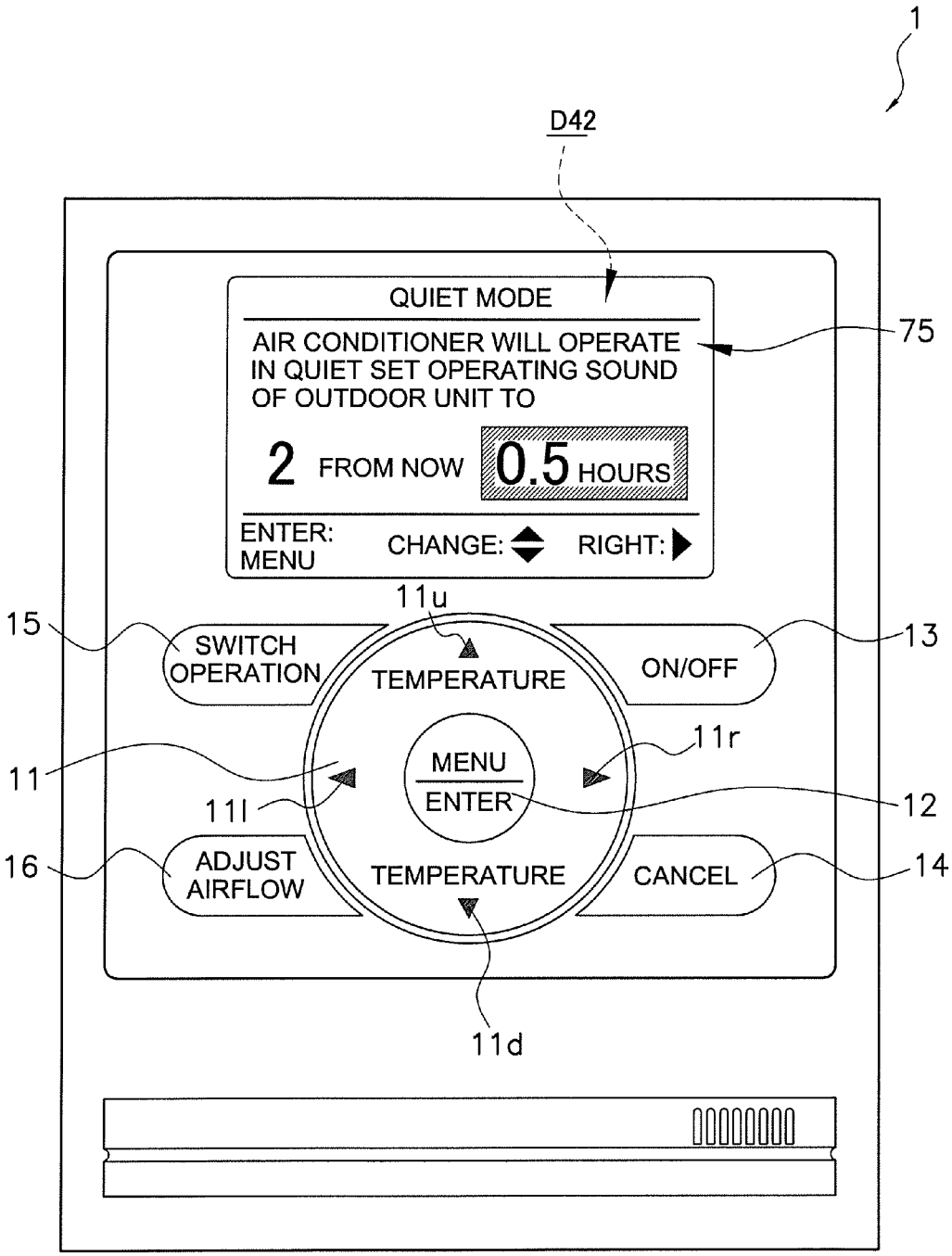
FIG. 17 is a diagram showing a display state of a setting display screen of a quiet mode function of the air conditioning controller.

FIG. 17 shows the air conditioning controller 1 in a state where it is performing "quiet mode" setting display screen display. Here, "quiet mode" is a function that reduces noise as a result of the outdoor control component 6 controlling operation of a compressor and the like of the outdoor unit 2.

Here, as shown in FIG. 17, a predetermined amount of time and the level of quietness can be set in the setting display screen.

<Characteristics of Air Conditioning Controller 1>

(1)

In the air conditioning controller 1 of the above-described embodiment, the control component 70 does not singly display, on the LCD 75, only numeric data whose setting has been received by operational input of the arrow key 11, but rather the control component 70 uses each of the setting display region data D422 and the explanation display region data D421 included in the setting display layout data D42 to cause numeric data that have been operationally inputted from the arrow key 11 to be displayed in one screen together with the operation explanation data D42*a* and the relationship explanation data D42*b*. For this reason, not only are set values simply displayed, but an explanation of the operation of a function executed in the air conditioner 100 and the relationship between the explanation of the operation of the function and the set values are explained, so the user can easily understand what kind of operation of a function of the air conditioner 100 that a set value corresponds to. Thus, numeral data that have been received by operational input of the arrow key 11 are displayed in the setting display region data D422, so the user can set values while viewing the display of the LCD 75 and being conscious of what kind of operation of a function of the air conditioner 100 that the user is setting.

It will be noted that, as described above, each of the various data of the operation explanations, the relationship explanations and the set values are displayed on one screen in the display of the LCD 75, so the user can understand the operation that is executed by the setting by just looking at the screen, and it is not necessary for the user to separately refer to an instruction manual or the like relating to display, which saves trouble.

(2)

In the air conditioning controller 1 of the above-described embodiment, the title of a function that the user is currently setting is displayed in the upper portion of the screen of the LCD 75 in the setting display screen, so the user can easily understand the function that the user is currently setting. For this reason, the user-friendliness of the air conditioning controller 1 can be improved.

(3)

In the air conditioning controller 1 of the above-described embodiment, when, as shown in FIG. 14, a plurality of the setting display region data D422 are being displayed at the same time and the user inputs each value to the setting display region data from the arrow key 11, the user can perform setting of setting display region data D422 to which the user has not inputted values while understanding which of the plural setting display region data D422 the user has finished inputting values to. Thus, the user can perform set and input with the arrow key 11 while understanding the relationship with each set numeric value.

(4)

In the air conditioning controller 1 of the above-described embodiment, the control component 70 receives selection of any of the titles in the arrow key 11 in a state where, as shown in FIG. 13, the function content explanation title ("function explanation") and the setting title ("condition setting (cooling)") are being displayed in the setting higher level layout data D3. Additionally, data are directly linked to each of the title data, so the function content explanation data ("The temperature will return to an initial set temperature after a certain amount of time. This function is invalid during automatic mode selection." shown in FIG. 15) are directly displayed in the function content explanation layout data (the display layout shown in FIG. 15) in accordance with a selection, and the operation explanation data D42*a* ("The cooling set temperature" and "will return" shown in FIG. 14), the relationship explanation data ("in _ minutes" and "to _ ° C." shown in FIG. 14) and numeric data ("30" and "28" shown in FIG. 14) can be displayed in the setting display layout data D42. In this case, the air conditioning controller 1 can transition to display of the setting display layout data D42 by just returning to just one higher level (display resulting from the setting higher level layout data D3) after displaying the function content explanation layout data D41. Thus, each display can be performed without having to perform operation such as significantly returning to a higher level.

INDUSTRIAL APPLICABILITY

By utilizing the present invention, it is possible to understand the relationship between operations of functions and set values by just display content, so the present invention is particularly useful when it is applied to an air conditioning controller that specifically displays setting content.

What is claimed is:

1. An air conditioning controller configured to operate an air conditioner, the air conditioning controller comprising:

a storage component having stored operation explanation data, relationship explanation data, and setting layout display data stored therein, the stored operation explanation data defining operations of functions executed in the air conditioner based on set numeric data, the relationship explanation data defining relationships between explanations of operations of functions and the set numeric data, and the setting display layout data including setting display region data used to display the set numeric data and explanation display region data used to display the operation explanation data and the relationship explanation data;

a data receiving component configured to receive the set numeric data;

a display component configured to display data; and a control component configured to cause the set numeric data that the data receiving component has received to be displayed in a setting display region of the display component while causing the operation explanation data and the relationship explanation data to be displayed in an explanation display region of the display component in accordance with the setting display layout data, the setting display region being derived from the setting display region data and the explanation display region being derived from the explanation display region data, and the setting display region and the explanation display region being disposed to show the relationships between the set numeric data and both the operation explanation data and the relationship explanation data.

2. The air conditioning controller according to claim 1, wherein the storage component is further configured to store per-function title data in accordance with the operation explanation data, the setting display layout data further includes title display region data used to display the per-function title data, and the control component is further configured to cause the set numeric data that the data receiving component has received to be displayed in the setting display region of the display component while respectively causing the operation explanation data and the relationship explanation data to be displayed in the explanation display region of the display component and the per-function title data to be displayed in a title display region of the display component in accordance with the setting display layout data.

3. The air conditioning controller according to claim 2, wherein the display component includes a plurality of setting display regions, the relationship explanation data including a plurality of sets of relationship explanation data, and the control component is further configured to cause a plurality of sets of numeric data that the data receiving component has received to be displayed in the setting display regions of the display component while causing the operation explanation data and the plurality of sets of the relationship explanation data to be displayed in the explanation display region of the display component in accordance with the setting display layout data.

4. The air conditioning controller according to claim 3, wherein the storage component is further configured to store function content explanation data, function content explanation layout data and selection layout data, the function content explanation data defining contents of the functions, the function content explanation layout data being used to display the function content explanation data, and the selection layout data being used to display function content explanation titles that are directly linked to the function content explanation layout data and setting titles that are directly linked to the setting display layout data, the data receiving component is further configured to receive selection data of either the function content explanation titles or the setting titles, and the control component and the display component are further configured such that the display component performs display in accordance with the selection layout data, performs display in accordance with the function content explanation layout data when the function content explanation titles have been selected in the data receiving component, and performs display in accordance with the setting display layout data when the setting titles have been selected in the data receiving component.

5. The air conditioning controller according to claim 2, wherein the storage component is further configured to store function content explanation data, function content explanation layout data and selection layout data, the function content explanation data defining contents of the functions, the function content explanation layout data being used to display the function content explanation data, and the selection layout data being used to display function content explanation titles that are directly linked to the function content explanation layout data and setting titles that are directly linked to the setting display layout data, the data receiving component is further configured to receive selection data of either the function content explanation titles or the setting titles, and the control component and the display component are further configured such that the display component performs display in accordance with the selection layout data, performs display in accordance with the function content explanation layout data when the function content explanation titles have been selected in the data receiving component, and performs display in accordance with the setting display layout data when the setting titles have been selected in the data receiving component.

6. The air conditioning controller according to claim 1, wherein the display component includes a plurality of setting display regions, the relationship explanation data including a plurality of sets of relationship explanation data, and the control component is further configured to cause a plurality of sets of numeric data that the data receiving component has received to be displayed in the setting display regions of the display component while causing the operation explanation data and the plurality of sets of the relationship explanation data to be displayed in the explanation display region of the display component in accordance with the setting display layout data.

7. The air conditioning controller according to claim 6, wherein the storage component is further configured to store function content explanation data, function content explanation layout data and selection layout data, the function content explanation data defining contents of the functions, the function content explanation layout data being used to display the function content explanation data, and the selection layout data being used to display function content explanation titles that are directly linked to the function content explanation layout data and setting titles that are directly linked to the setting display layout data, the data receiving component is further configured to receive selection data of either the function content explanation titles or the setting titles, and the control component and the display component are further configured such that the display component performs display in accordance with the selection layout data, performs display in accordance with the function content explanation layout data when the function content explanation titles have been selected in the data receiving component, and performs display in accordance with the setting display layout data when the setting titles have been selected in the data receiving component.

8. The air conditioning controller according to claim 1, wherein the storage component is further configured to store function content explanation data, function content explanation layout data and selection layout data, the function content explanation data defining contents of the functions, the function content explanation layout data being used to display the function content explanation data, and the selection layout data being used to display function content explanation titles that are directly linked to the function content explanation layout data and setting titles that are directly linked to the setting display layout data, the data receiving component is further configured to receive selection data of either the function content explanation titles or the setting titles, and the control component and the display component are further configured such that the display component performs display in accordance with the selection layout data, performs display in accordance with the function content explanation layout data when the function content explanation titles have been selected in the data receiving component, and performs display in accordance with the setting display layout data when the setting titles have been selected in the data receiving component.

9. The air conditioning controller according to claim 1, wherein the set numeric data including numeric set temperature information and numeric time duration information, which are indicative of how long the control unit will maintain a current set temperature before returning to numeric set temperature included in the numeric set temperature information.

10. The air conditioning controller according to claim 9, wherein the relationship explanation data is indicative of the current set temperature reverting to the numeric set temperature information in a time duration indicated by the numeric time duration information.

11. The air conditioning controller according to claim 10, wherein the operation explanation data is indicative of the current set temperature returning to the numeric set temperature.

12. The air conditioning controller according to claim 9, wherein the operation explanation data is indicative of the current set temperature returning to the numeric set temperature.

* * * * *